US008567623B2

(12) United States Patent
Shah et al.

(10) Patent No.: US 8,567,623 B2
(45) Date of Patent: Oct. 29, 2013

(54) HOT-FILL CONTAINER HAVING A TAPERED BODY AND DOME

(75) Inventors: Sunil S. Shah, York, PA (US); Benton A. Lewis, Manchester, PA (US); Sheldon E. Yourist, York, PA (US); April M. Peacock, York, PA (US)

(73) Assignee: Graham Packaging Company, L.P., York, PA (US)

( * ) Notice: Subject to any disclaimer, the term of this patent is extended or adjusted under 35 U.S.C. 154(b) by 527 days.

(21) Appl. No.: 12/579,665

(22) Filed: Oct. 15, 2009

(65) Prior Publication Data

US 2011/0088360 A1 Apr. 21, 2011

(51) Int. Cl.
*B65D 1/02* (2006.01)
*B65D 1/46* (2006.01)

(52) U.S. Cl.
USPC ..... 215/381; 215/384; 220/666; 220/675

(58) Field of Classification Search
USPC ..... 215/379.381, 382, 384, 398; 220/666, 220/667, 675
See application file for complete search history.

(56) References Cited

U.S. PATENT DOCUMENTS

| | | | | |
|---|---|---|---|---|
| 4,805,788 | A | 2/1989 | Akiho | |
| 4,818,575 | A | 4/1989 | Hirata et al. | |
| 4,946,053 | A | 8/1990 | Conrad | |
| 5,067,622 | A | 11/1991 | Garver et al. | |
| 5,178,290 | A | 1/1993 | Ota et al. | |
| 5,199,588 | A | 4/1993 | Hayashi | |
| 5,222,615 | A | 6/1993 | Ota et al. | |
| 5,238,129 | A | 8/1993 | Ota | |
| 5,310,068 | A | 5/1994 | Saghri | |
| 5,971,184 | A * | 10/1999 | Krishnakumar et al. | 215/384 |
| D453,004 | S | 1/2002 | Hirata | |
| 6,398,052 | B1 * | 6/2002 | Cheng et al. | 215/384 |
| 6,467,639 | B2 * | 10/2002 | Mooney | 215/384 |
| D466,813 | S | 12/2002 | Thierjung et al. | |
| 6,659,300 | B2 * | 12/2003 | Wurster et al. | 215/379 |
| D510,034 | S * | 9/2005 | Hong et al. | D9/645 |
| 7,080,747 | B2 * | 7/2006 | Lane et al. | 215/381 |
| D545,198 | S | 6/2007 | Hatcher et al. | |
| D547,665 | S | 7/2007 | Lepoitevin | |
| D548,087 | S | 8/2007 | Wolf | |
| 2003/0000912 | A1 * | 1/2003 | Deubel et al. | 215/384 |
| 2003/0116527 | A1 * | 6/2003 | Beaver et al. | 215/382 |
| 2003/0205550 | A1 * | 11/2003 | Prevot et al. | 215/384 |
| 2004/0016716 | A1 * | 1/2004 | Melrose et al. | 215/381 |
| 2004/0159627 | A1 * | 8/2004 | Trude | 215/381 |
| 2004/0159628 | A1 * | 8/2004 | Trude | 215/382 |
| 2004/0200799 | A1 * | 10/2004 | Yourist et al. | 215/381 |
| 2005/0269284 | A1 * | 12/2005 | Pedmo et al. | 215/381 |
| 2006/0157439 | A1 * | 7/2006 | Howell | 215/384 |
| 2008/0173613 | A1 * | 7/2008 | Ross | 215/379 |
| 2008/0257856 | A1 * | 10/2008 | Melrose et al. | 215/381 |

* cited by examiner

*Primary Examiner* — Sue A Weaver
(74) *Attorney, Agent, or Firm* — Baker Botts L.L.P.

(57) ABSTRACT

A hot-fill container has a body portion that may utilize interchangeable dome-like top portion. A top portion is located above the body portion and has a bumper portion located thereon. A bottom portion is located below the body portion and has a bumper portion located thereon.

15 Claims, 8 Drawing Sheets

HOT-FILL CONTAINER HAVING A TAPERED BODY AND DOME

BACKGROUND OF THE INVENTION

1. Field of the Invention

The present invention is related to the field of containers. In particular the present invention relates to a method and apparatus for manufacturing a hot-fill container having a tapered body and dome.

2. Description of the Related Technology

Plastic containers are frequently used due to their durability and lightweight nature. Polyethylene terephthalate (PET) is used to construct many of today's containers. PET containers are lightweight, inexpensive, recyclable and manufacturable in large quantities.

PET containers are used for products, such as beverages and semi-solid foods. Often these liquid products, such as juices, isotonics and sauces, are placed into the containers while the liquid product is at an elevated temperature, typically between 68° C.-96° C. (155° F.-205° F.) and usually about 85° C. (185° F.). When packaged in this manner, the hot temperature of the liquid is used to sterilize the container at the time of filling. This process is known as hot-filling. The containers that are designed to withstand the process are known as hot-fill containers.

A variety of methods can be used to manufacture PET containers. One such method is called the "two-step" process. The "two-step" process first involves forming a plastic preform for use in the blow molding process.

A plastic "preform" is typically a tubular shaped object that comprises a finish, a neck and body. The preforms are then placed into molds and subjected to the blow molding process. This step may be formed at some point later in time. The two step blow molding process is used in order to manufacture large amounts of containers using the preforms.

Another type of blow molding process is a one step blow molding process. The one step blow molding process, in contrast to the two step blow molding process discussed above, involves forming the preform and the finished container without the need to cool the preform fully to form the preform such as in the two step process discussed above. Instead the preform in the one step blow molding process is only cooled to the point in which it can be removed from the mold. The formed preforms in the two step blow molding process are then immediately subjected to the blow molding process.

The blow molded containers may then be filled, with either a cold fill or alternatively, hot-filled. After being hot-filled, the hot-filled containers are capped and allowed to reside at about the filling temperature for a predetermined amount of time. The containers and stored liquid may then be cooled so that the containers may be transferred to labeling, packaging and shipping operations. As the liquid stored in the container cools, thermal contraction occurs resulting in a reduction of volume. This results in the volume of liquid stored in the container being reduced. The reduction of liquid within the sealed container results in the creation of a negative pressure or vacuum within the container. If not controlled or otherwise accommodated for, these negative pressures result in deformation of the container which leads to either an aesthetically unacceptable container or one which is unstable. The container must be able to withstand such changes in pressure without failure.

The negative pressure within the container has typically been compensated for by the incorporation of flex panels in the sidewall of the container. Traditionally, these paneled areas have been semi-rigid by design and are unable to accommodate the high levels of negative pressure generated in some lightweight containers. Currently, hot-fill containers typically include substantially rectangular vacuum panels that are designed to collapse inwardly after the container has been filled with hot product. These flex panels are designed so that as the liquid cools, the flex panels will deform and move inwardly. The adjacent portions of the container, such as the so-called lands, or columns, which are located between, above, and below the flex panels, are intended to resist any deformations which would otherwise be caused by hot-fill processing. Wall thickness variations, or geometric structures, such as ribs, projections and the like, can be utilized to prevent unwanted distortion. Generally, the typical hot-fillable container structure is provided with certain pre-defined areas which flex to accommodate volumetric changes and certain other pre-defined areas which remain unchanged.

During the fill process, existing machinery typically only permits two points of contact, which typically are located on the body of the container. The need to have the points of contact located on the body results in a restrictive geometry and shape for containers that have domes. This is because the dome needs be shaped in order to avoid interfering with the machinery that grips the containers on the fill line. Therefore, there exists a need in the field to have a container that is able to use differently shaped domes that are able to accommodate having a point of contact located on the dome so as to permit more varied design in the construction of plastic containers.

SUMMARY OF THE INVENTION

An object of the present invention may be a hot-fill container that has a point of contact located on the top portion for permitting contact on the fill line.

Another object of the present invention is a method for making a hot-fill container that has a point of contact located on the top portion for permitting contact on the fill line.

Yet another object of the invention may be a hot-fill container that uses interchangeable dome structure with similar body portions.

Still yet another object of the invention may be a method for making a hot-fill container that uses interchangeable top portion structure with similar body portions.

An aspect of the present invention may be a hot-fill container comprising; a top portion having an upper top portion, a first bumper portion located below the upper top portion, and a lower top portion located below the first bumper portion; a body portion located below the lower top portion; and a base portion located below the body portion, wherein the base portion comprises a second bumper portion.

Another aspect of the present invention may be a hot-fill container comprising; a top portion having an upper top portion, a first bumper portion located below the upper top portion, and a lower top portion located below the first bumper portion; an interconnect portion located below the top portion; a body portion located below the interconnect portion, wherein the body portion comprises two opposing flex panels; and a base portion located below the body portion, wherein the base portion comprises a second bumper portion.

Still yet another aspect of the present invention may be a method of hot-filling a container comprising; providing a hot-fill container comprising a top portion having an upper top portion, a first bumper portion located below the upper top portion, and a lower top portion located below the first bumper portion; a body portion located below the lower top portion; and a base portion located below the body portion, wherein the base portion comprises a second bumper portion;

gripping the container at the first bumper portion and the second bumper portion; hot-filling the container; and capping the container.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
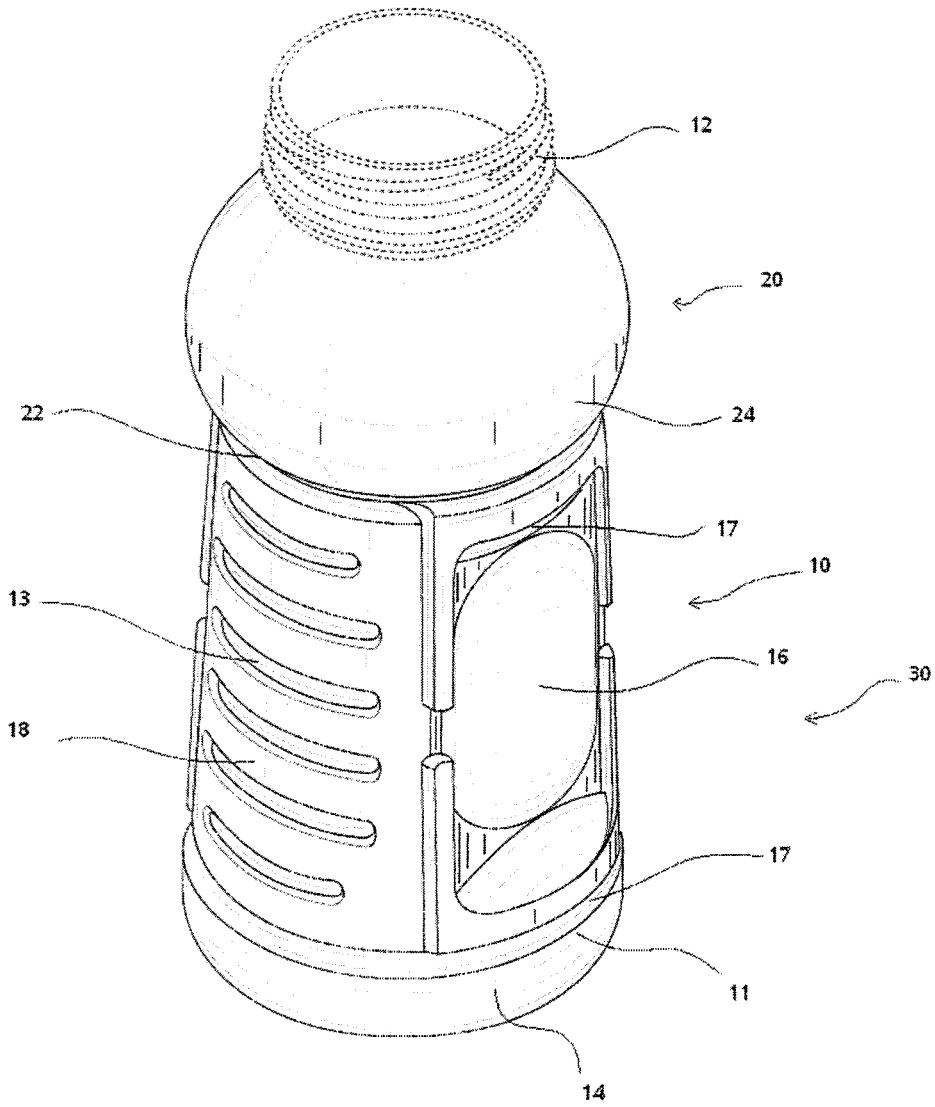
FIG. 1 is an isometric view of a container, in accordance with an embodiment of the present invention.

Referring now to the drawings, wherein like reference numerals refer to corresponding structure throughout and referring in particular to FIG. 1, wherein an isometric view of a container 10 is shown that is made in accordance with an embodiment of the present invention.

The hot-fill container 10 may be used to package a wide variety of liquid and/or viscous products such as juices, and other fluids and beverages (such as sauces, salsas, etc.) that are amenable to the hot-fill process.

The container 10 may have a one-piece construction and may be prepared from a monolayer plastic material, such as a polyamide, for example, nylon; a polyolefin such as polyethylene, for example, low density polyethylene (LDPE), high density polyethylene (HDPE), polypropylene, a polyester, for example, polyethylene terephthalate (PET), polyethylene naphtalate (PEN), or others, which may also include additives to vary the physical or chemical properties of the material. For example, some plastic resins may be modified to improve the oxygen permeability. Alternatively, the container may be prepared from a multilayer plastic material. The layers may be any plastic material, including virgin, recycled and reground material. The layers and may include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. In an exemplary embodiment, the present container is prepared from PET.

The container 10 is constructed to withstand the rigors of hot-fill processing. Container 10 may be made by conventional blow molding processes including, for example, extrusion blow molding, stretch blow molding and injection blow molding. These molding processes are discussed briefly below.

For example, with extrusion blow molding, a molten tube of thermoplastic material, or plastic parison, is extruded between a pair of open blow mold halves. The blow mold halves close about the parison and cooperate to provide a cavity into which the parison is blown to form the container. As so formed, container 10 may include extra material, or flash, at the region where the molds come together. A moil may be intentionally present above the container finish.

After the mold halves open, the container 10 drops out and is then sent to a trimmer or cutter where any flash of moil attached to the container 10 is removed. The finished container 10 may have a visible ridge (not shown) formed where the two mold halves used to form the container came together. This ridge is often referred to as the parting line.

With stretch blow molding a pre-formed parison, or preform, is prepared from a thermoplastic material, typically by an injection molding process. The pre-form typically includes an opened, threaded end, which becomes the threaded member 18 of the container 10. The pre-form is positioned between two open blow mold halves. The blow mold halves close about the pre-form and cooperate to provide a cavity into which the pre-form is blown to form the container. After molding, the mold halves open to release the container 10. For wide mouth containers, the container 10 may then be sent to a trimmer where the moil is removed.

With injection blow molding, a thermoplastic material may be extruded through a rod into an injection mold in order to form a parison. The parison is then positioned between two open blow mold halves. The blow mold halves close about the parison and cooperate to provide a cavity into which the parison may be blown to form the container 10. After molding, the mold halves open to release the container 10.

Plastic blow-molded containers, particularly those molded of PET, are utilized in hot-fill applications. Hot-filling involves filling the container 10 with a liquid product heated to a temperature in excess of 180° F. (i.e., 82° C.), capped immediately after filling, and then allowed to cool to ambient temperatures via a cold water rain or submersion.

In the construction of containers it is important to keep the container's top load and hot-fill performance characteristics strong. The structural integrity of the container must be maintained after the hot-fill process. Furthermore, consideration must be made for preventing bulging of the container 10 that can occur with containers.

The hot-fill container 10 shown in FIG. 1 has a threaded neck portion 12 that is located above the top portion 20. The top portion 20 as shown in FIG. 1 is dome shaped and located above the interconnect portion 22. By "dome shaped" it is meant that the top portion 20 is generally a partially spherical structure that may also have vertically and/or horizontally sloped surfaces. The top portion 20 has a bumper portion 24 that provides a contact point for the gripping mechanism used on the processing line during the hot-fill process. The bumper portion 24 functions to keep the container 10 straight while on the processing line. It should be understood that while the top portion 20 is shown as dome shaped that other shapes and geometries may be formed so long as there is sufficient structure that may operate as the bumper portion 24.

Located below the interconnect portion 22 is the body portion 30. The body portion 30 shown in FIG. 1 has two label sides 18 that are opposite to each other. The label sides 18 have a plurality of support ribs 13 that provide support for the label sides 18 to prevent deformation during the hot-fill process. Also located on the body portion 30 are a number of flex panels 16 that may also function as a gripping area. The flex panels 16 are surrounded by frame portion 17. The flex panels 16 may accommodate the vacuum absorption made necessary by the fill process. The body portion 30 is located above and integrally connected to the base portion 14. The base portion 14 provides a base bumper portion 13 that provides a contact point for the gripping mechanism used on the processing line during the hot-fill process machinery.

Figure 2:
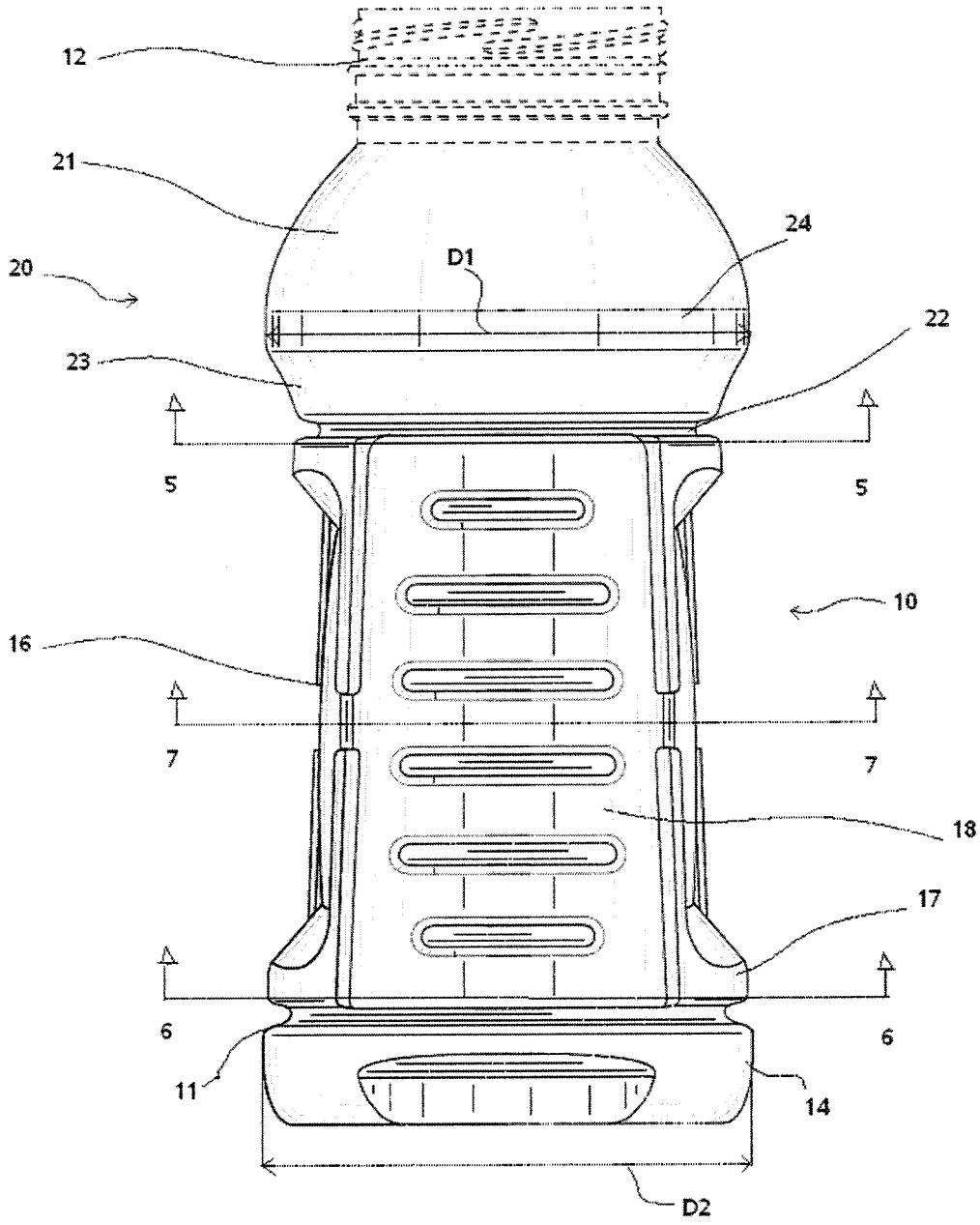
FIG. 2 is a front view of the container shown in FIG. 1.

FIG. 2 shows a front view of the container 10 shown in FIG. 1. In FIG. 2 the top portion 20 has an upper top portion 21 which is located above the bumper portion 24 and forms part of the dome shape. The surface of the upper top portion 21 slopes in towards the longitudinal axis A towards the threaded neck portion 12. The top portion 20 also has a lower top portion 23 that is located below the bumper portion 24. The surface of the lower top portion 23 slopes in towards the longitudinal axis A to the interconnect portion 22.

The diameter D1 of the bumper portion 24 is equal to the diameter D2 of the base bumper portion 13 and the base portion 14. The diameter D1, typically corresponds to the diameter of the bumper portion 24, and may be twice the radial distance from the longitudinal axis of the container 10 to the surface of the bumper portion 24. When the container 10 is viewed from the front the diameter D1 may correspond to the distance between the distal most points located on the bumper portion 24. This enables the provision of the contact points for the gripping mechanism used on the processing line during the hot-fill process. The diameter D2, typically corresponds to the diameter of the base bumper portion 13, and may be twice the radial distance from the longitudinal axis A of the container 10 to the base bumper portion 13. When the container 10 is viewed from the front the diameter D2 may correspond to the distance between the distal most points located on the base bumper portion 13. The provision of the bumper portion 24 on the top portion 20 enables the formation of the dome shape by permitting the usage of a geometry that may have a distance that extends further than the greatest distance of the body portion 30 when taken from one side to the other. Also, in order to provide enough structural support so as to accommodate the force applied from a gripping mechanism located on the processing, the bumper portion 24 may have a material thickness that is greater than the upper top portion 21 or the lower top portion 23.

Figure 3:
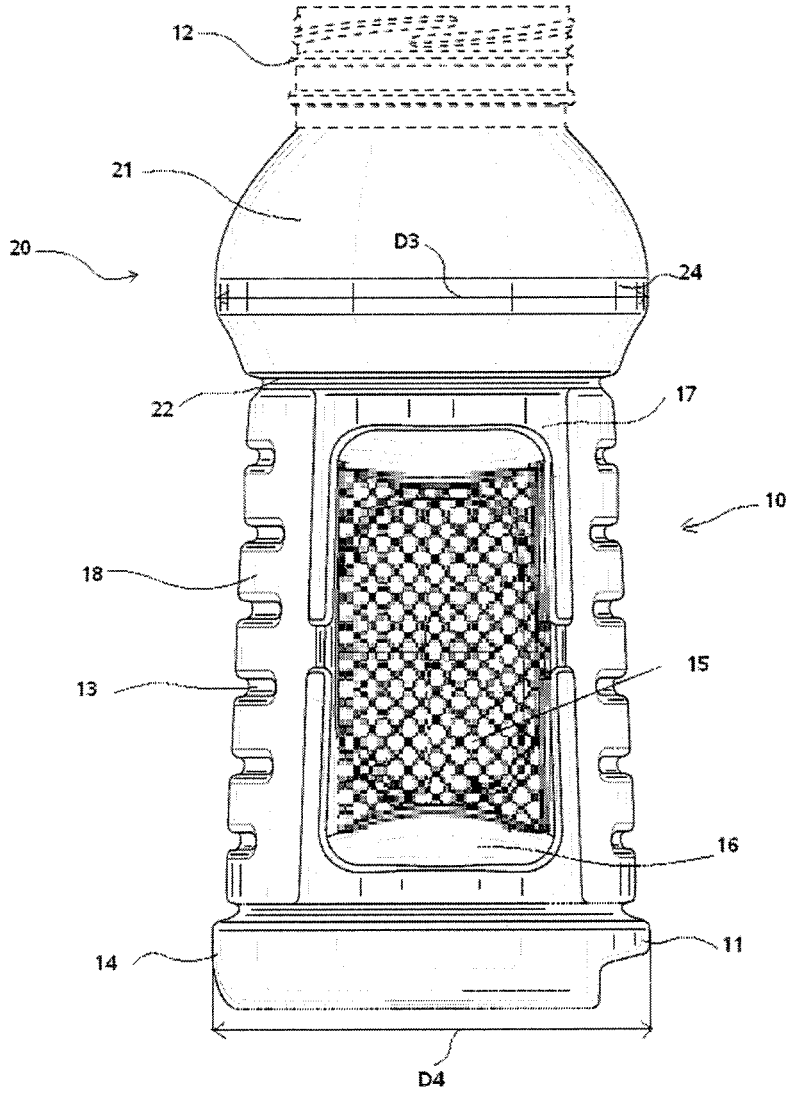
FIG. 3 is a side view of the container shown in FIG. 1 showing an optional textured surface.

FIG. 3 shows a side view of the container 10 shown in FIGS. 1 and 2 wherein an optional textured surface 15 is located on and/or forms part of the flex panel 16. The textured surface 15 provides an enhanced gripping surface for an individual to grab. Frame portion 17 surrounds the flex panel 16 and provides additional support and structure for the container 10 during the hot-fill process. The diameter D3 of the side view of the bumper portion 24 shown in FIG. 3 is equal to the diameter D4 of the side view of the base bumper portion 13. The values of D3 and D4 typically correspond to the diameter of the bumper portion 24 and the base bumper portion 13 respectively. In the embodiment shown in FIGS. 1-3, the diameter D1 is equal to the diameter D3 and the diameter D2 is equal to the diameter D4. However, it should be understood that in some embodiments the diameters D1 and D3 may not be equal to each other and the diameters D2 and D4 may not be equal to each other. In these embodiments, the diameters D1 and D2 still remain equal to each other and likewise the diameters D3 and D4 would remain equal to each other. In this case the containers 10 would have to be oriented in a similar direction on the filling conveyor.

Figure 4:
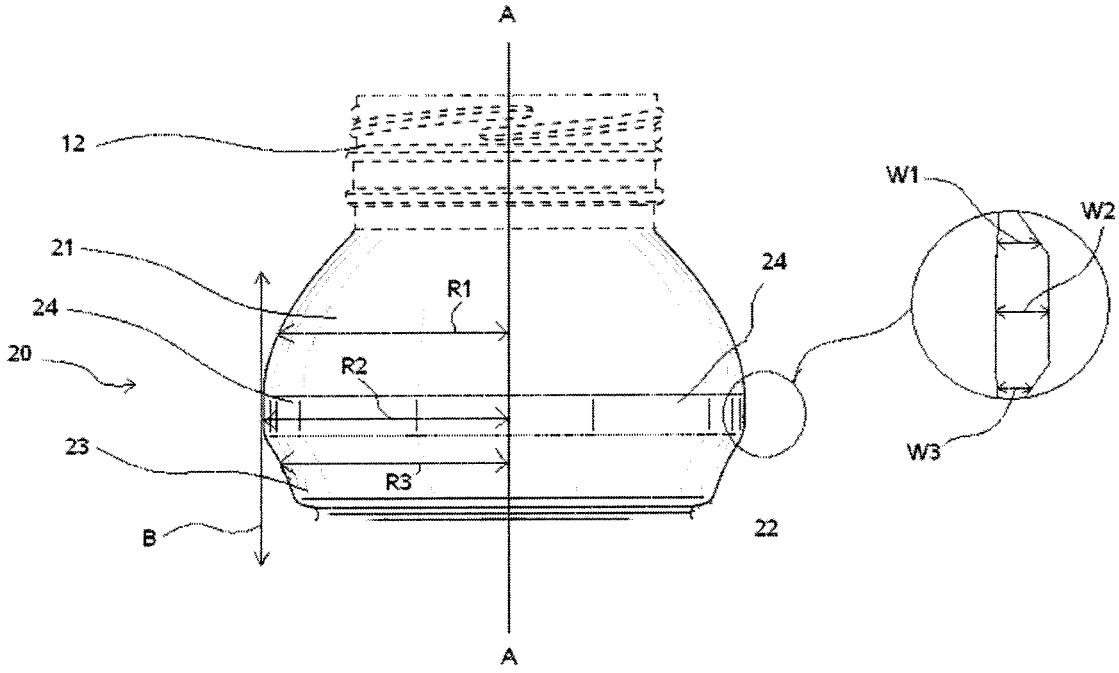
FIG. 4 is a detailed view of the top portion of the container shown in FIGS. 1-3.

FIG. 4 shows a detailed view of the top portion 20 used with the body portion 30 shown in FIGS. 1-3. The upper top portion 21 has a radius R1 that is taken from the surface of the upper top portion 21 to the longitudinal axis A of the container 10. Below the upper top portion 21 is the bumper portion 24 that has a radius R2 that is taken from the surface of the bumper portion 24 to the longitudinal axis A of the container 10. Located below the bumper portion 24 is the lower top portion 23 that has a radius R3 that is taken from the surface of the lower top portion 23 to the longitudinal axis A of the container 10.

Radius R1 is less than the radius R2 and may be about equal to the radius R3. Because the radii R1 and R3 are less than the radius R2 the surfaces of the upper top portion 21 and lower top portion 23 slope away from the surface of the bumper portion 24 and create the dome like structure of the top portion 20.

Bumper portion 24 is shown as a circular shaped portion of the top portion 20. The circular shaped bumper portion 24 may be constructed so that there are gaps between portions of the bumper portion 24. All that needs to occur is that there is sufficient physical presence to the bumper portion 24 so that it can interact with the hot-fill line machinery. The bumper portion 24 shown in FIG. 4 may have a planar surface B that is parallel to the longitudinal axis A of the container. Additionally the bumper portion 24 may be constructed of more material and have a thicker width W2 that is greater than the widths W1 and W3 of the upper top portion 21 and the lower top portion 23.

An interconnect portion 22 is located below the lower top portion 23 and connects the top portion 20 to the body portion 30. The interconnect portion 22 permits a transition between the top portion 20 and the body portion 30 that is capable of accommodating top portions 20 that are differently sized while retaining the same size and shape for the body portion 30.

Figure 5:
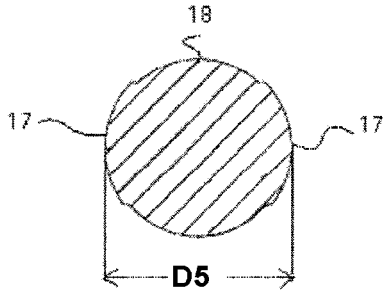
FIG. 5 is a cross-sectional view of the container taken along the line 5-5, shown in FIG. 2.
Figure 6:
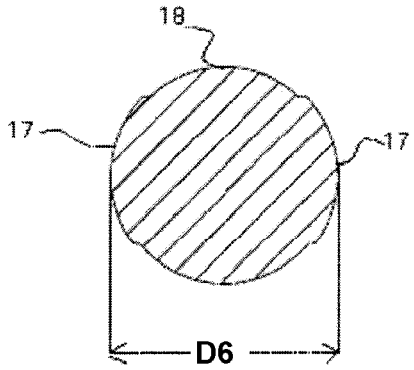
FIG. 6 is a cross-sectional view of the container taken along the line 6-6, shown in FIG. 2.
Figure 7:
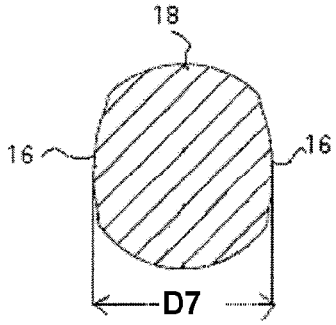
FIG. 7 is cross-sectional view of the container taken along the line 7-7, shown in FIG. 2.

FIG. 5 is a cross-sectional view of the body portion 30 with the cross-section taken along the line 5-5, shown in FIG. 2. FIG. 6 is a cross-sectional view body portion 30 with the cross-section taken along the line 6-6, shown in FIG. 2. FIG. 7 is a cross-sectional view of the body portion 30 taken along the line 7-7, shown in FIG. 2. The diameter D5 of the body portion 30 is less than the diameter D6. This results in a tapered appearance to the body portion 30. The diameter D7 is less than either the diameter D6 or the diameter D7 and reflects the distance between the flex panels 16 as opposed to the distance between the surfaces of the frame portions 17 shown in FIGS. 5 and 6. In other words, as FIG. 2 shows, a diameter D5 of the body portion 30 located proximate to the top or upper portion 20 is less than a diameter D6 of the body portion located proximate to the base portion 14.

Figure 8:
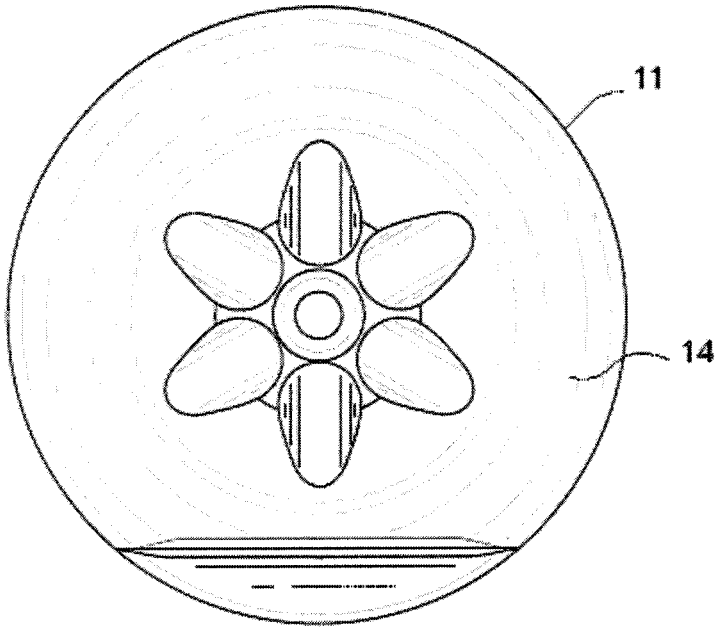
FIG. 8 is a bottom view of the container shown in FIG. 1.

FIG. 8 shows the base portion 14 of the container 10 having the base bumper portion 13. The base portion 14 is located below the body portion 30.

Figure 9:
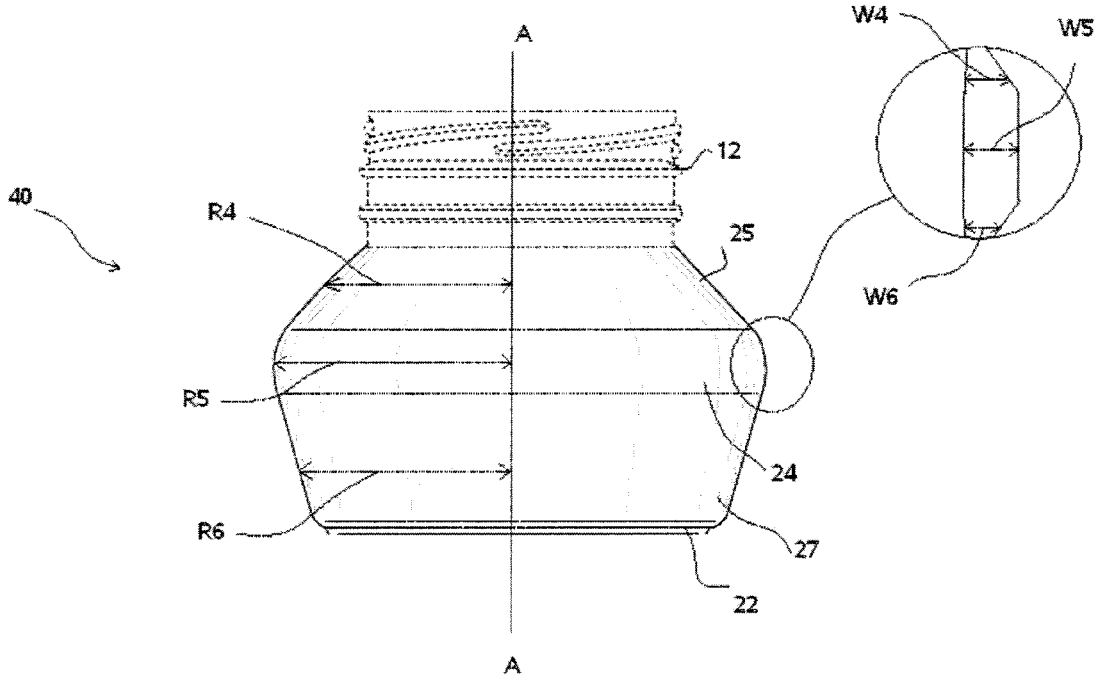
FIG. 9 is a detailed view of a top portion of a container in accordance with another embodiment of the invention that may be used with the body portion shown in FIGS. 1-3.

FIG. 9 shows a detailed view of the top portion 40 used with the body portion 30 shown in FIGS. 1-3. The upper top portion 25 has a radius R4 that is taken from the surface of the upper top portion 25 to the longitudinal axis A of the container 10. Below the upper top portion 25 is the bumper portion 24 that has a radius R5 that is taken from the surface of the bumper portion 24 to the longitudinal axis A of the container 10. Located below the bumper portion 24 is the lower top portion 27 that has a radius R6 that is taken from the surface of the lower top portion 27 to the longitudinal axis A of the container 10.

Radius R4 is less than the radius R5 and may be about equal to the radius R6. Because the radii R4 and R6 are less than the radius R5 the surfaces of the upper top portion 25 and lower top portion 27 slope away from the surface of the bumper portion 24 and create the dome like structure of the top portion 40. In comparison to the top portion 20 the lower top portion 27 is more steeply sloped than lower top portion 23 and as shown in the FIG. 9 is more flatly contoured than the top portion 20.

Bumper portion 24 is shown as a circular shaped portion of the top portion 40. The circular shaped bumper portion 24 may be constructed so that there are gaps between portions of the bumper portion 24. All that needs to occur is that there is sufficient physical presence to the bumper portion 24 so that it can interact with the hot-fill line machinery. The bumper portion 24 shown in FIG. 9, similar to the bumper portion 24 shown in FIG. 4, may have a planar surface B that is parallel to the longitudinal axis A of the container. Additionally the bumper portion 24 may be constructed of more material and have a thicker width W5 that is greater than the widths W4 and W6 of the upper top portion 25 and the lower top portion 27.

The usage of different top portions 20 and 40 used with the same body portion 30 results in lower mold costs that are then able to attain different brand identities. These iterations allow the customer to operate with lower manufacturing costs and higher outputs as well as operational efficiencies. The dome styles may be incorporated on a circular or non-circular horizontal section of the mold.

Figure 10:
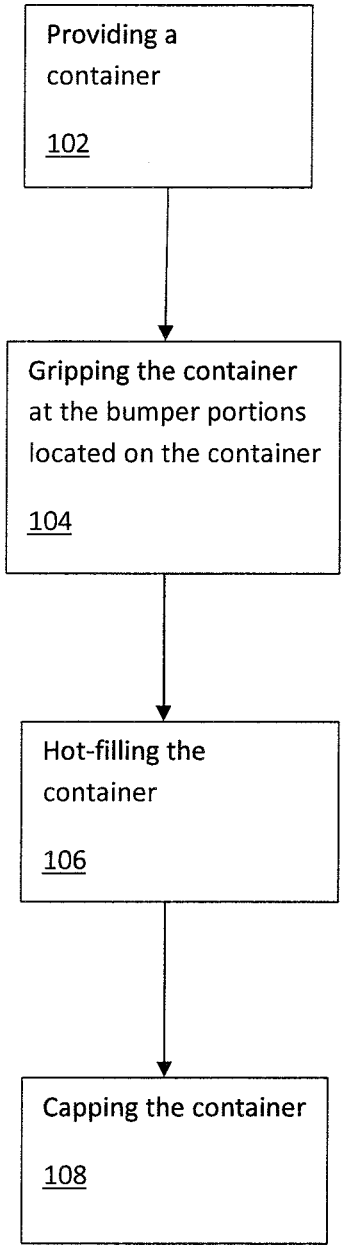
FIG. 10 is a flow chart of the hot-filling process.

FIG. 10 is flow chart providing the steps of hot-filling the container 10. The same method is applicable to each of the containers disclosed herein. In step 102, the container 10 is provided. In step 104, the container 10 is gripped by the hot-fill machinery at the bumper portion 24 and the base bumper portion 13. The bumper portion 24 and the base bumper portion 13 keep the container 10 vertical while on the hot-fill processing line. In step 106 the container 10 is hot-filled. In step 108, the container 10 is capped.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hot-fill container comprising;

a top portion having an upper top portion, a first bumper portion located below the upper top portion, and a lower top portion located below the first bumper portion;

a body portion located below the lower top portion, the body portion having two opposed label sides, each of which has a plurality of support ribs defined therein, the body portion further having a pair of opposed flex panels, each of which is constructed without a reinforcement rib and surrounded by a frame portion, and wherein a first diameter of the body portion that is located proximate to the top portion is less than a second diameter of the body portion that is located proximate to the base portion, and wherein a third diameter of the body portion taken through the opposed flex panels is less than the first diameter and the second diameter; and a base portion located below the body portion, wherein the base portion comprises a second bumper portion.

2. The hot-fill container of claim 1, wherein a contact surface of the first bumper portion is parallel to a longitudinal axis of the container.

3. The hot-fill container of claim 1, wherein the top portion is dome shaped.

4. The hot-fill container of claim 1, wherein the upper top portion has a first radius, the first bumper portion has a second radius and the lower top portion has a third radius; and further wherein the first radius and the third radius are each less than the second radius.

5. The hot-fill container of claim 1, wherein the first bumper portion has a first diameter and the second bumper portion has a second diameter; and further where the first diameter is equal to the second diameter.

6. The hot-fill container of claim 1, wherein the body portion is tapered.

7. The hot-fill container of claim 1, wherein the two opposing flex panels each have a textured surface.

8. The hot-fill container of claim 1, wherein the upper top portion has a first width, the first bumper portion has a second width and the lower top portion has a third width; and further wherein the second width is greater than each of the first width and the third width.

9. The hot fill container of claim 1, wherein the first bumper portion and the second bumper portion are substantially round in transverse cross-section.

10. A hot-fill container comprising;

a top portion having an upper top portion, a first bumper portion located below the upper top portion defining a maximum upper bumper portion width, and a lower top portion located below the first bumper portion;

an interconnect portion located below the top portion;

a body portion located below the interconnect portion, wherein the body portion comprises a pair of opposed flex panels, each of which is constructed without a reinforcement rib and surrounded by a frame portion, and wherein a first diameter of the body portion that is located proximate to the top portion is less than a second diameter of the body portion that is located proximate to the base portion, and wherein a third diameter of the body portion taken through the opposed flex panels is less than the first diameter and the second diameter; and a base portion located below the body portion, wherein the base portion comprises a second bumper portion defining a maximum lower bumper portion width that is substantially the same as the maximum upper bumper portion width.

11. The hot-fill container of claim 10, wherein a contact surface of the first bumper portion is parallel to a longitudinal axis of the container.

12. The hot-fill container of claim 10, wherein the top portion is dome shaped.

13. The hot-fill container of claim 10, wherein the body portion is tapered.

14. The hot-fill container of claim 10, wherein the two opposing flex panels each have a textured surface.

15. The hot fill container of claim 10, wherein the first bumper portion and the second bumper portion are substantially round in transverse cross-section.

* * * * *